United States Patent [19]

Walther et al.

[11] 4,118,896

[45] Oct. 10, 1978

[54] APPARATUS FOR SURFACE TREATMENT OF PARTS WITH A VIBRATORY CONTAINER

[75] Inventors: Carl Kurt Walther, Wuppertal; Henning D. Walther, Haan; Hubert P. Hagelueken, Dusseldorf; Karl Temme, Wuppertal, all of Fed. Rep. of Germany

[73] Assignee: Wheelabrator-Frye Inc., Hampton, N.H.

[21] Appl. No.: 668,134

[22] Filed: Mar. 18, 1976

[51] Int. Cl.[2] ..... B24B 31/06

[52] U.S. Cl. ..... 51/163.2; 74/87

[58] Field of Search ..... 259/72; 241/175; 51/163.1, 163.2; 74/61, 87

[56] References Cited

U.S. PATENT DOCUMENTS

| | | | |
|---|---|---|---|
| 3,266,327 | 8/1966 | Felixon | 74/87 |
| 3,793,780 | 2/1974 | Musschoot | 51/163.1 X |
| 3,877,178 | 4/1975 | Campanelli | 51/163.2 |

*Primary Examiner*—Harold D. Whitehead

*Attorney, Agent, or Firm*—McDougall, Hersh & Scott

[57] ABSTRACT

A vibratory apparatus for the surface treatment of parts with media in which the apparatus includes a generator for inducing supplementary vibrations superimposed upon the basic vibrations, in which the generator is in the form of a free oscillatory means of a bowl housed within a race for circular movement about an axis parallel with the axis of the means inducing the basic vibrations.

5 Claims, 3 Drawing Figures

APPARATUS FOR SURFACE TREATMENT OF PARTS WITH A VIBRATORY CONTAINER

This invention relates to an apparatus for surface treatment of parts with a resiliently supported vibratory container subjected to basic oscillations and to supplementary oscillations superimposed upon the basic oscillations to cause movement of parts and media.

It is known to design a vibratory container as an annular vessel. In such instance, vertically spaced eccentric weights, mounted for rotation about a vertical axis, are preferably used as generators for the vibratory movement. By changing the rate of revolution and adjustment of the imbalance of the weights relative to each other, it is possible to vary both amplitude and frequency of vibrational movement, as well as the rate of directional movement. However, there is a limit to the amount of variation, so that only part of the desired surface treatment is accomplished.

It is an object of this invention to provide an apparatus of the type described designed to permit wide adjustment of operating conditions, with corresponding improvement in surface treatment.

The solution to the problem is recited in Claim 1, with further advantageous embodiment recited in the dependent claims.

Based on the design of this invention, apparatus of the type described has greater functional value. The basic design of the apparatus, as known in the prior art, need not be changed. Instead, there is provided a supplementary vibratory generator at an appropriate location on the apparatus. During surface treatment, the basic vibrations are modified by the supplemental vibrations of higher frequency acting on the container, and correspondingly on the material contained therein. The desired conditions, heretofore not available for surface treatment with the basic vibrations, can be achieved by the cumulative effect of the supplemental vibrations. Moreover, an improved surface treatment of parts is achieved with reduction in treatment time.

The supplemental vibration can itself be varied to enable further adjustments to be obtained. Moreover, the treatment effect can be influenced by the adjustment of the plane of vibration of the additional oscillations of the supplemental generator. The supplemental vibrations can be aligned for movement in a plane horizontal or vertical to the vibratory container or even at an angle thereto.

The generator for the supplementary vibrations can be variable in design. For example, it can be designed to be operated electro-mechanically, mechanically, pneumatically, or hydraulically. It can also be designed so that only the supplemental oscillations are transmitted to the container for the surface treatment of parts.

An advantageous design is in the form of a free swinging means. Because of the action of the basic vibrations, there is no precisely defined frequency. This, however, does not adversely affect the surface treatment but instead makes available the advantage of simplification of the supplementary oscillations. For example, an applicable free swinging means comprises a ball vibrator which is driven by compressed air. It is simple in design and not prone to disturbances. The frequency of the ball vibrator is determined essentially by the air pressure.

As a result of directing the supplementary vibrations opposite to the rotary component of the basic vibrations, the surface treatment effect is increased. Moreover, the material contained in the vessel is stabilized. For example, in a vibratory container wherein the content material flows in a spiral path, surface treatment of the parts can be effected in a single path. For this purpose, the oscillations originating from the supplemental generator are adapted to account for movement of the parts in a direction opposite to the direction of movement induced by the basic vibrations.

Coaxial superpositioning of both vibrators offers advantages from a technical standpoint of manufacture and use. The generator for the supplemental vibrations is preferably located on top of the unit thereby to facilitate access thereto. If desired, the generator for the additional vibrations can be simply inactivated.

An embodiment of the invention is hereinafter described with reference to FIGS. 1 to 3, in which FIG. 1 is a sectional elevational view through an apparatus embodying the features of this invention, with the supplemental vibrator shown in elevational view at the top;

Figure 1:
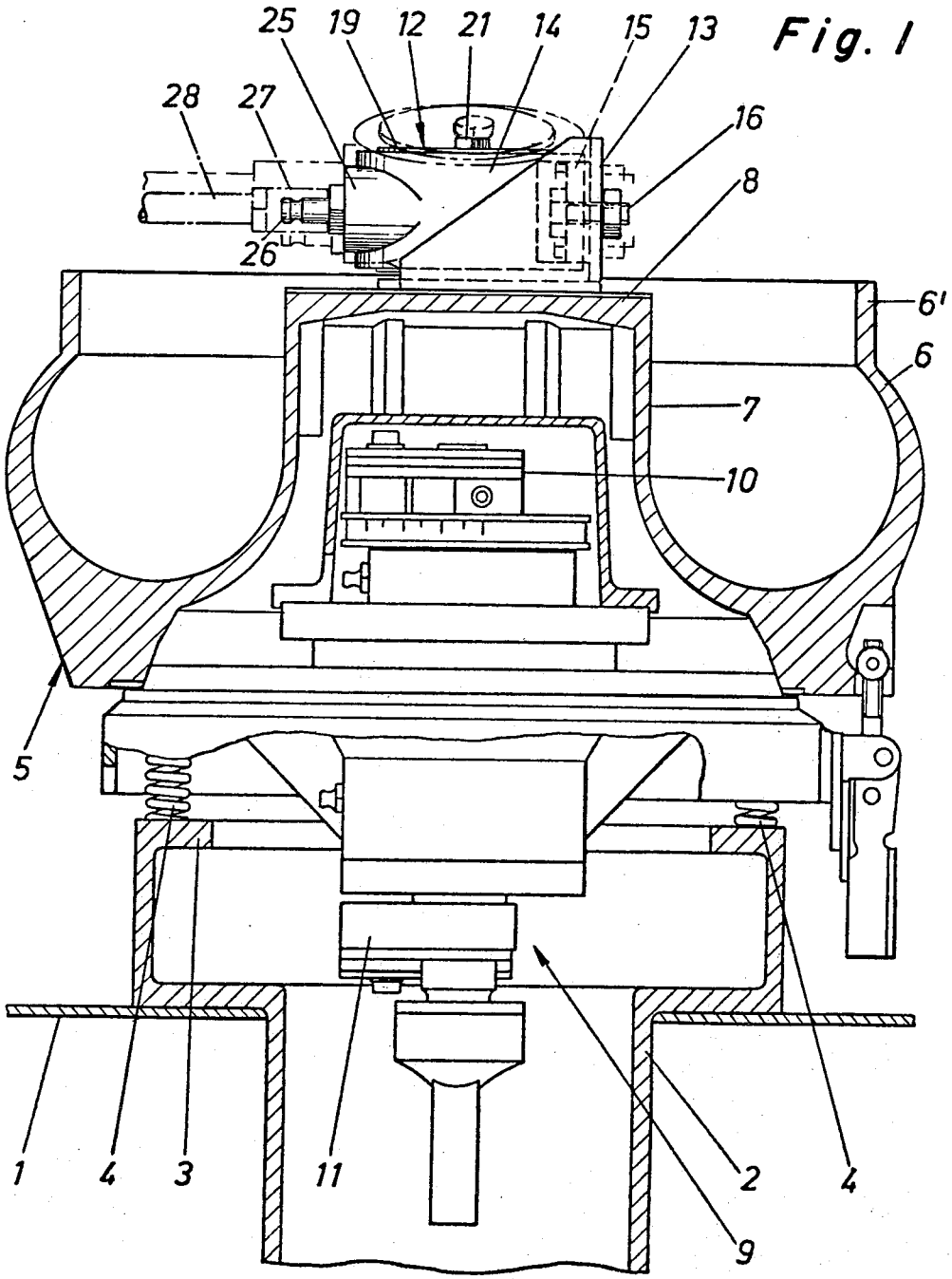
Figure 2:
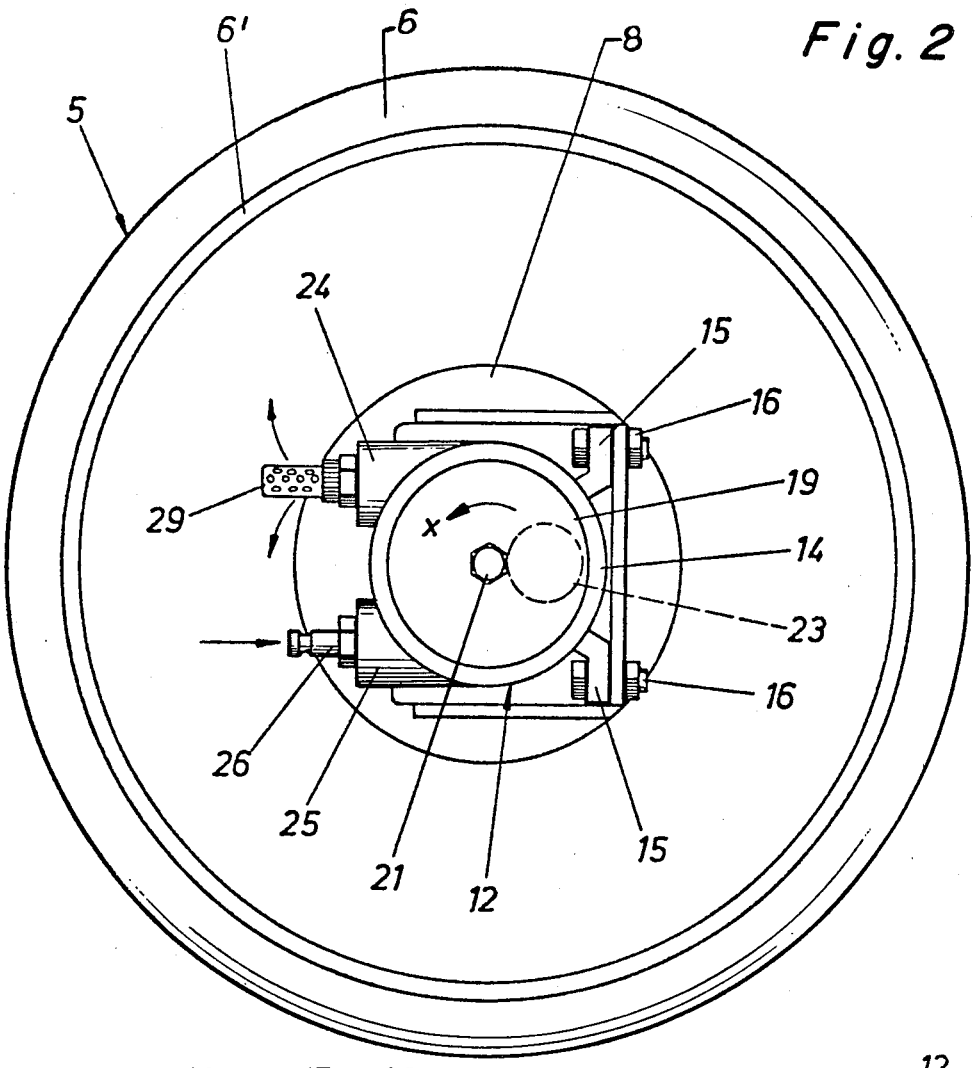
FIG. 2 is a top plan view of the apparatus shown in FIG. 1.
Figure 3:
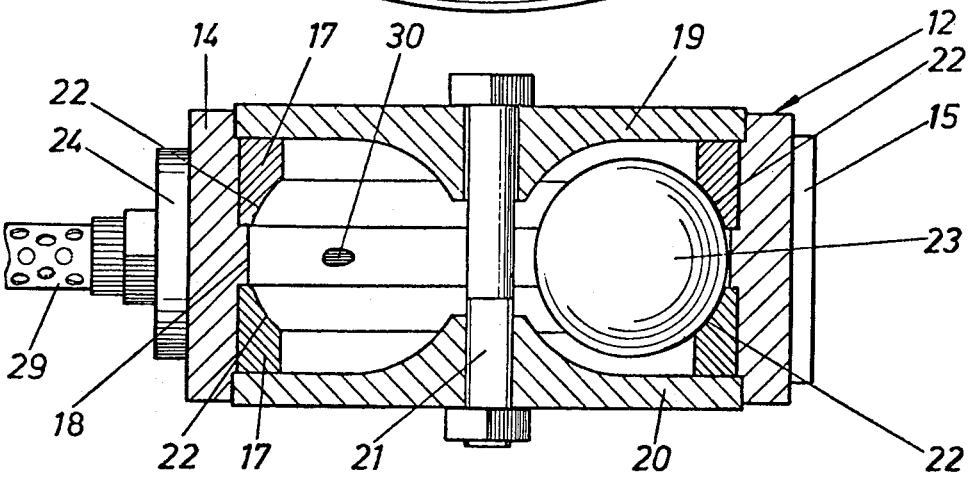
FIG. 3 is a sectional elevational view through the generator in the form of a free oscillator for the supplemental oscillations.

The apparatus is provided with a base 2 located on a supporting panel 1. Compression springs 4 are seated about the frontal edge 3 of the base 2 and on which the vibratory container 5 is supported for vibratory movement. The vibratory container is designed as an annular bowl with approximately an annular cross-section. The outer wall 6 of the container has an inwardly drawn edge 6'. The inner wall of the container is joined at its upper edge to a central flat horizontally disposed plate 8.

The vibrator 9, for inducing the basic vibrations, is located centrally within the free area of base 2 and of the vibratory container 5. Said vibrator 9 comprises an electrical motor 9' for rotational movement of an axial shaft 9'' on which there are mounted the vertically spaced imbalance or eccentric weights 10 and 11 which are reciprocally adjustable.

The generator 12, for the supplementary oscillations, is arranged coaxially to the generator 9 of the basic vibrations. For this purpose, a mounting bracket 13 is fixed on the flat plate 8 which supports the generator 12 for the supplementary oscillations designed as free swinging means. The free swinging means 12 comprises a ball vibrator having a bearing housing 14 from which supporting legs 15 extend for connection to the mounting bracket 13 by means of screws 16.

The bearing housing 14 is provided with two spaced bearing rings 17 mounted coaxially in relation to each other and chamfered on the inside. They extend against an inner central collar 18 of the bearing housing 14. The bearing housing is enclosed by two covers 19 and 20 secured to each other in the assembled relation, under tension, by means of screw 21. The chamfering 22 of the bearing rings 17 is designed to correspond to the diameter of the ball 23.

The conduits 24 and 25, arranged parallel to each other, extend from opposite sides of the bearing housing. The slip-on nipple 26 for the slip-on bushing 27 of a compressed air duct 28, shown in dot and dash lines in FIG. 1, is provided at the end of the conduit 25.

The perforated air discharge pipe 29 extends from the other conduit 24. The slip-on nipple 26 and the air discharge pipe 29 are connected via openings 30 to the interior of the bearing housing. In operation, ball 23 is caused to rotate in the direction of the arrow X by the supply of compressed air. The direction of rotation is thus made opposite to that of the vibrator 9.

In order to disconnect the generator 12 of the supplementary vibrations, one merely has to remove the slip-on bushing 27 from the slip-on nipple.

It will be apparent that the bearing housing can be rocked about its supporting bracket to fix the housing at various angles, or that it can be inverted for rotation of the ball in the opposite direction and that the speed of rotation of the bowl can be adjusted by variation in the compressed air from the standpoint of rate of flow and pressure.

In operation, the bowl is loaded with media and parts to be subjected to surface treatment whereby, when the basic and supplementary vibratory means are activated, the parts and media are subjected to vibratory movement as they are caused to move in a spiral or orbitol path about the bowl at a rate and in vibratory frequency depending upon the adjustment of the basic vibrations as modified by the superimposed supplementary vibrations.

Surface treatment of the parts with the media is effective to improve the surface finish of the parts, remove burrs or flashings from the parts, or to provide other surface treatment before the parts are separated from the media.

We claim:

1. An apparatus for the surface treatment of parts with media comprising a horizontally disposed annular vessel in which said parts and media are received, means resiliently mounting said annular vessel for multi-directional movement, eccentric means connected to the annular vessel for imparting basic vibrations to said annular vessel comprising one or more eccentrics mounted for rotational movement about the vertical axis of the annular vessel, and a supplementary vibration generator means mounted on the annular vessel separate and apart from but in axial alignment with the eccentric means for inducing vibrations independently of the basic vibrations, and means for angular adjustment of said supplmentary vibration generator means for varying the plane of vibration between the horizontal to the vertical of the container.

2. An apparatus as claimed in claim 1 in which the additional vibrations are higher in frequency.

3. An apparatus as claimed in claim 1 in which the supplemental generator is a freely oscillating means.

4. An apparatus as claimed in claim 3 in which the freely oscillating means of the supplemental generator comprises a circular race, a ball mounted within said race for free circulation about the race, and means for driving the ball for circulation about the race.

5. An apparatus as claimed in claim 1 in which the direction of rotation of the supplemental vibrations derived from the generator is opposite to that of the basic vibrations.

* * * * *